US006740402B2

(12) United States Patent
Tsukamoto

(10) Patent No.: US 6,740,402 B2
(45) Date of Patent: May 25, 2004

(54) POLYESTER FIBER

(75) Inventor: Ryoji Tsukamoto, Ehime (JP)

(73) Assignee: Teijin Limited, Osaka (JP)

( * ) Notice: Subject to any disclaimer, the term of this patent is extended or adjusted under 35 U.S.C. 154(b) by 0 days.

(21) Appl. No.: 10/312,981

(22) PCT Filed: Jul. 13, 2001

(86) PCT No.: PCT/JP01/06104

§ 371 (c)(1),
(2), (4) Date: Jan. 3, 2003

(87) PCT Pub. No.: WO02/06573

PCT Pub. Date: Jan. 24, 2002

(65) Prior Publication Data

US 2003/0143397 A1 Jul. 31, 2003

(30) Foreign Application Priority Data

Jul. 14, 2000 (JP) ..... 2000-213948
Aug. 7, 2000 (JP) ..... 2000-238251

(51) Int. Cl.[7] ..... D02G 3/00; C08F 20/00; C08G 63/02

(52) U.S. Cl. ..... 428/364; 528/298; 528/302; 528/307; 528/308; 528/308.6; 525/437; 525/440; 525/443

(58) Field of Search ..... 528/298, 302, 528/307, 308, 308.6; 525/437, 440, 443; 428/364

(56) References Cited

U.S. PATENT DOCUMENTS 2,901,466 A 8/1959 Kibler et al.
3,959,215 A 5/1976 Schneider
4,115,350 A 9/1978 Lazarus et al.
4,130,541 A 12/1978 Lazarus et al.
4,152,318 A 5/1979 Lazarus et al.
4,331,800 A * 5/1982 Inata et al. ..... 528/289
4,351,936 A * 9/1982 Matsumura et al. ..... 528/289
5,169,499 A 12/1992 Eagles et al.
5,246,992 A 9/1993 Wick et al.
5,385,773 A 1/1995 Yau et al.
5,686,552 A * 11/1997 Masuda et al. ..... 528/193

FOREIGN PATENT DOCUMENTS

GB 1426409 2/1976
JP 8-120521 A 5/1996
KR 9500732 1/1995
WO WO 90/12918 A1 11/1990
WO WO 90 12918 11/1990

OTHER PUBLICATIONS

International Search Report for PCT JP01 06194 dated Oct. 30, 2001.
International Preliminary Examination Report for PCT JP01 06104 (Japanese).

* cited by examiner

*Primary Examiner*—Samuel A. Acquah
(74) *Attorney, Agent, or Firm*—Sughrue Mion, PLLC

(57) ABSTRACT

Polyester fibers comprising a copolyester which simultaneously satisfies the following respective requirements (a) to (c), (a) a terephthalic acid component in an amount of 0 to 100 mol % and a 2,6-naphthalenedicarboxylic acid component in an amount of 100 to 0 mol % respectively based on the whole dicarbxylic acid component, wherein the total amount, of the terephthalic acid component and the 2,6-naphthalenedicarboxylic acid component, accounts for 90 mol % or more based on the whole dicarboxylic acid component, (b) a trimethylene glycol component accounts for 0 to 100 mol % and a 1,4-cyclohexanedimethanol component accounts for 100 to 0 mol % respectively based on the whole glycol component, wherein the total amount, of the trimethylene glycol component and the 1,4-cyclohexanedimethanol component, accounts for 90 mol % or more based on the whole glycol component and (c) the sum total value of mol % of the 2,6-naphthalenedicarboxylic acid component and mol % of the 1,4-cyclohexanedimethanol component is 2 mol % or more.

9 Claims, No Drawings

POLYESTER FIBER

TECHNICAL FIELD

The present invention relates to polyester fibers and more particularly it relates to polyester fibers having resistances to hydrolysis and fatigue from flexing at high levels and suitably usable for applications of papermaking canvas, tire cord and sterilized fabrics.

BACKGROUND ART

As well known, copolyesters have widely been used for fibers, resins, films or the like due to excellent performances thereof. Especially, polyester fibers are excellent in dimensional stability, heat, chemical and light resistances and the like and utilized in various fields regardless of clothing and non-clothing uses.

In the situation, polyester fibers have recently been utilized even for papermaking canvas such as dryer canvas, tire cord and sterilized fabrics such as medical clothes from the viewpoint of excellence in strength and resistance to fatigue from flexing. Among them, high resistances to fatigue and hydrolysis sufficient to withstand uses at high temperature and humidity are required in the applications of the dryer canvas and sterilized fabrics. The copolyesters, however, have problems that the lowering of molecular weight and the like are caused by hydrolysis at high temperature and humidity due to chemical characteristics thereof and the copolyester is resultantly unsuitable for long term uses at high temperature and humidity.

In order to solve the problems, for example, JP-A No. 54-6051 (1976) and JP-A No. 3-104919 (1991) (hereinafter, JP-A means Japanese Unexamined Patent Publication) propose methods for adding an epoxy compound or a carbodiimide compound as methods for reducing the terminal carboxyl group concentration of polyethylene terephthalate. Although resistance to hydrolysis is improved to some extent according to the methods, the copolyester are incapable of withstanding long-term uses and the problems have not yet been solved.

On the other hand, JP-A No. 8-120521 (1996) proposes filaments using a polytrimethylene terephthalate as a method for raising the resistance to fatigue from flexing. Although resistances to both fatigue from flexing and hydrolysis are considerably improved, the resistance of the filaments to hydrolysis for long-term and continuous uses at high temperature and humidity has not yet reached a sufficient level due to a low glass transition point of the polytrimethylene terephthalate.

DISCLOSURE OF THE INVENTION

It is an object of the present invention to solve the problems heretofore possessed by the above prior art and to provide polyester fibers having resistances to both hydrolysis and fatigue from flexing which are capable of withstanding long-term and continuous uses at high temperature and humidity.

BEST MODE FOR CARRYING OUT THE INVENTION

The mode for carrying out the present invention will be detailed hereinafter.

In the present invention, it is necessary for a copolyester which is formed into the polyester fibers to simultaneously satisfy the following respective requirements (a) to (c).

(a) a terephthalic acid component in an amount of 0 to 100 mol % and a 2,6-naphthalenedicarboxylic acid component in an amount of 100 to 0 mol % respectively based on the whole dicarboxylic acid component, wherein the total amount, of the terephthalic acid component and the 2,6-naphthalenedicarboxylic acid component, accounts for 90 mol % or more based on the whole dicarboxylic acid component, (b) a trimethylene glycol component accounts for 22 to 100 mol % and a 1,4-cyclohexanedimethanol component accounts for 78 to 0 mol % respectively based on the whole glycol component, wherein the total amount, of the trimethylene glycol component and the 1,4-cyclohexanedimethanol component, accounts for 90 mol % or more based on the whole glycol component and (c) the sum total value of mol % of the 2,6-naphthalenedicarboxylic acid component and mol % of the 1,4-cyclohexanedimethanol component is 2 mol % or more.

The respective requirements (a) to (c) in the present invention will be detailed hereinafter.

When the total amount of the terephthalic acid component and the 2,6-naphthalenedicarboxylic acid component is less than 90 mol % based on the whole dicarboxylic acid component, the resistances to hydrolysis and heat, hand touch and the like of the resulting fibers are lowered.

When the 1,4-cyclohexanedimethanol component is not contained as the glycol component of the copolyester in the present invention, the case where the amount of the terephthalic acid component is 98 mol % or more and/or the amount of the 2,6-naphthalenedicarboxylic acid component is less than 2 mol % is unfavorable because the resistance of the resulting fibers to hydrolysis becomes insufficient.

As to the amounts of the terephthalic acid component and the 2,6-napthalenedicarboxylic acid component, it is preferable to make the terephthalic acid component account for 5 to 95 mol % and the 2,6-napthalenedicarboxylic acid component account for 95 to 5 mol % and keep the total amount of the terephthalic acid component and 2,6-naphthalenedicarboxylic acid component within the range of 92 mol % or more based on the whole dicarboxylic acid component and it is more preferable to make the terephthalic acid component account for 8 to 92 mol % and the 2,6-naphthalenedicarboxylic acid component account for 92 to 8 mol % and keep the total amount of the terephthalic acid component and the 2,6-naphthalenedicarboxylic acid component within the range of 95 mol % or more based on the whole dicarboxylic acid component.

When the total amount of the trimethylene glycol component and the 1,4-cyclohexanedimethanol component is less than 90 mol % based on the whole glycol component, the resistances to hydrolysis and heat, hand touch and the like of the resulting fibers are lowered.

When the 2,6-naphthalenedicarboxylic acid component is not contained as the dicarboxylic acid component of the copolyester in the present invention, the case where the amount of the trimethylene glycol component is less than 22 mol % and/or the amount of the 1,4-cyclohexanedimethanol component is larger than 78 mol % is unfavorable because the resulting fibers have hard hand touch and the melting point is increased to lower the molding processability. Furthermore, the resistance of the resulting fibers to hydrolysis becomes insufficient if the amount of the trimethylene glycol component is 98 mol % or more and/or the amount of the 1,4-cyclohexanedimethanol component is less than 2 mol %.

As to the amounts of the trimethylene glycol component and the 1,4-cyclohexanedimethanol component, it is preferable to make the trimethylene glycol component account for 22 to 95 mol % and the 1,4-cyclohexanedimethanol component account for 78 to 5 mol % and keep the total amount of the trimethylene glycol component and the 1,4-cyclohexanedimethanol component within the range of 92 mol % or more based on the whole glycol component and it is more preferable to make the trimethylene glycol component account for 22 to 92 mol % and the 1,4-cyclohexanedimethanol component account for 78 to 8 mol % and keep the total amount of the trimethylene glycol component and the 1,4-cyclohexanedimethanol component within the range of 95 mol % or more based on the whole glycol component.

In addition, it is necessary for the sum total value of mol % of the 2,6-naphthalenedicarboxylic acid component and mol % of the 1,4-cyclohexanedimethanol component in the copolyester of the present invention to be 2 mol % or more. The object of the present invention can only be achieved by the sum total value kept within the range.

Components other than the terephthalic acid component, 2,6-naphthalenedicarboxylic acid component, trimethylene glycol component and 1,4-cyclohexanedimethanol component may be copolymerized with the copolyester formed into the polyester fibers of the present invention within the range so as not to deteriorate characteristics of the copolyester, preferably within the range of 5 mol % or less based on the whole dicarboxylic acid component.

Examples of the copolymerization component include aromatic dicarboxylic acids such as isophthalic acid, o-phthalic acid, diphenyldicarboxylic acid, diphenyl ether-dicarboxylic acid, diphenyl sulfonedicarboxylic acid, benzophenonedicarboxylic acid, phenylindanedicarboxylic acid, a 5-sulfoxyisophthalic acid metal salt or a 5-sulfoxyisophthalic acid phosphonium salt; aliphatic glycols such as ethylene glycol, tetramethylene glycol, pentamethylene glycol, hexamethylene glycol, octamethylene glycol, decamethylene glycol, neopentylene glycol, diethylene glycol, triethylene glycol, polyethylene glycol, polytetramethylene glycol or cyclohexanediol; alicyclic glycols such as 1,4-cyclohexanediol; aromatic glycols such as o-xylylene glycol, m-xylylene glycol, p-xylylene glycol, 1,4-bis(2-hydroxyethoxy)benzene, 1,4-bis(2-hydroxyethoxyethoxy)benzene, 4,4'-bis(2-hydroxyethoxy)biphenyl, 4,4'-bis(2-hydroxyethoxyethoxy)biphenyl, 2,2-bis[4-(2-hydroxyethoxy)phenyl]propane, 2,2-bis[4-(2-hydroxyethoxyethoxy)phenyl]propane, 1,3-bis(2-hydroxyethoxy)benzene, 1,3-bis(2-hydroxyethoxyethoxy)benzene, 1,2-bis(2-hydroxyethoxy)benzene, 1,2-bis(2-hydroxyethoxyethoxy)benzene, 4,4'-bis(2-hydroxyethoxy)diphenyl sulfone or 4,4'-bis(2-hydroxyethoxyethoxy)diphenyl sulfone and diphenols such as hydroquinone, 2,2-bis(4-hydroxyphenyl)propane, resorcinol, catechol, dihydroxynaphthalene, dihydroxybiphenyl or dihydroxydiphenyl sulfone. The components may be used alone or in combination of two or more kinds thereof.

The glass transition temperature of the copolyester formed into the fibers in the present invention is preferably 45° C. or above. When the glass transition temperature is 45° C. or above, the resistance to hydrolysis is more raised. The range of the glass transition temperature is more preferably 46° C. or above, especially preferably 48° C. or above.

When the glass transition temperature is too high, the moldability of the polymer is lowered. Therefore, the glass transition temperature may be usually 85° C. or below and is preferably 80° C. or below.

The copolyester formed into the polyester fibers of the present invention has a terminal carboxyl group concentration preferably within the range of 30 eq/ton or below. When the terminal carboxyl group concentration is within the range, the resistance of the fibers to hydrolysis is more improved. The terminal carboxyl group concentration is more preferably within the range of 25 eq/ton or below, especially preferably within the range of 20 eq/ton or below.

A bisoxazoline compound in an amount of 0.05 to 5% by weight based on the copolyester is preferably added and uniformly mixed and melt spinning is then preferably carried out when the copolyester used in the present invention is melt spun and formed into the polyester fibers. When the amount of the added bisoxazoline compound is within the range, the terminal carboxyl group concentration of the resulting polyester fibers becomes far lower to resultantly take effect on the suppression of the lowering of the intrinsic viscosity, an improvement in the resistance to hydrolysis and the like without increasing the degree of polymerization of the copolyester too much and lowering the melt moldability or without lowering the resistance of the resulting polyester fibers to heat. The amount of the added bisoxazoline compound is more preferably within the range of 0.07 to 4% by weight, especially preferably within the range of 0.1 to 3% by weight.

Examples of the bisoxazoline compound herein include 2,2'-bis(2-oxazoline), 2,2'-bis(4-methyl-2-oxazoline), 2,2'-bis(4,4-dimethyl-2-oxazoline), 2,2'-bis(4-ethyl-2-oxazoline), 2.2'-bis(4,4'-diethyl-2-oxazoline), 2,2'-bis(4-propyl-2-oxazoline), 2,2'-bis(4-butyl-2-oxazoline), 2,2'-bis(4-hexyl-2-oxazoline), 2,2'-bis(4-phenyl-2-oxazoline), 2,2'-bis(4-cyclohexyl-2-oxazoline), 2,2'-bis(4-benzyl-2-oxazoline), 2,2'-p-phenylenebis(2-oxazoline), 2,2'-m-phenylenebis(2-oxazoline), 2,2'-o-phenylenebis(2-oxazoline), 2,2'-p-phenylenebis(4-methyl-2-oxazoline), 2,2'-p-phenylenebis(4,4-dimethyl-2-oxazoline), 2,2'-m-phenylenebis(4-methyl-2-oxazoline), 2,2'-m-phenylenebis(4,4-dimethyl-2-oxazoline), 2,2'-ethylenebis(2-oxazoline), 2,2'-tetramethylenebis(2-oxazoline), 2,2'-hexamethylenebis(2-oxazoline), 2,2'-octamethylenebis(2-oxazoline), 2,2'-deccamethylenebis(2-oxazoline), 2,2'-ethylenebis(4-methyl-2-oxazoline), 2,2'-tetramethylenebis(4,4-dimethyl-2-oxazoline), 2,2'-9,9'-diphenoxyethanebis(2-oxazoline), 2,2'-cyclohexylenebis(2-oxazoline), 2,2'-diphenylenebis(2-oxazoline) and the like. Among them, 2,2'-bis(2-oxazoline) is most preferred from the viewpoint of reactivity with the copolyester.

Further, one kind of the bisoxazoline compound described above may be used alone or two or more kinds may be used in combination insofar as the bisoxazoline compound is effective in achieving the object of the present invention.

Although methods for adding the bisoxazoline compound to the copolyester are not especially restricted when the bisoxazoline compound is added to the copolyester in the present invention, there are preferably adopted methods for dissolving the bisoxazoline compound, for example, in an organic solvent unreactive with the bisoxazoline compound and adding the bisoxazoline compound to polyester chips or a polyester in a molten state and mixing the bisoxazoline compound with the polyester chips or the polyester in the molten state, methods for adding the bisoxazoline compound kept in a powder state to the polyester chips or the polyester in the molten state and mixing the bisoxazoline compound with the polyester chips or the polyester in the molten state, methods for premixing the bisoxazoline compound in a polyester, for example, polytrimethylene terephthalate or polyethylene terephthalate so as to provide a high concentration and mixing the resulting master chips with the polyester chips without adding the compound in chip states and the like.

When the copolyester used in the present invention is melt spun and formed into the polyester fibers, a polycarbodiimide compound in an amount within the range of 0.05 to 5% by weight based on the copolyester is preferably added and uniformly mixed with the copolyester. When the amount of the added polycarbodiimide compound is within the range, the terminal carboxyl group concentration of the resulting polyester fibers becomes far lower to resultantly take effect on the suppression of the lowering of the intrinsic viscosity, an improvement in the resistance to hydrolysis and the like without increasing the degree of polymerization of the copolyester too much and lowering the melt moldability or without lowering the resistance of the resulting polyester fibers to heat. The amount of the added polycarbodiimide compound is preferably within the range of 0.07 to 4% by weight, especially preferably within the range of 0.1 to 3% by weight.

Poly(2,4,6-triisopropylphenyl-1,3-carbodiimide is most preferred as the polycarbodiimide compound from the viewpoint of reactivity with the copolyester.

Although methods for adding the polycarbodiimide compound to the copolyester are not especially restricted when the polycarbodiimide compound is added to the copolyester in the present invention, there are specially preferably adopted methods for premixing the polycarbodiimide compound with a polyester, for example, polytrimethylene terephthalate or polyethylene terephthalate at a high concentration, providing master chips, then blending the chips and mixing the polycarbodiimide compound with the copolyester.

A monocarbodiimide compound in an amount within the range of 0.01 to 3% by weight based on the copolyester may be further added when the polycarbodiimide compound is added so as to melt spin the copolyester and form the copolyester into the polyester fibers in the present invention. The amount of the added monocarbodiimide compound is preferably within the range of 0.03 to 2% by weight, especially preferably within the range of 0.05 to 1% by weight. Bis(2,6-diisopropylphenyl)carbodiimide is most preferred as the monocarbodiimide compound from the viewpoint of the reactivity with the copolyester.

The intrinsic viscosity of the copolyester formed into the polyester fibers in the present invention is preferably 0.52 to 1.6. When the intrinsic viscosity is lower than 0.52, mechanical characteristics of the copolyester are lowered and the strength of the finally obtained fibers is liable to be insufficient. When the intrinsic viscosity exceeds 1.6, there is a tendency to lower the fluidity during the melting of the polymer and lower the moldability. The intrinsic viscosity of the copolyester is preferably within the range of 0.53 to 1.5, more preferably within the range of 0.55 to 1.4.

The copolyester can be produced by a conventionally known method, and there can be adopted methods for subjecting, for example a terephthalic acid component, a 2,6-naphthlanedicarboxylic acid component and a glycol component to esterification reaction or subjecting lower alkyl ester components of the terephthalic acid and the 2,6-naphthlanedicarboxylic acid and the glycol component to transesterification in the presence of a transesterification catalyst, providing a bisglycol ester and/or a precondensate thereof and then subjecting the resulting bisglycol and/or the precondensate thereof to polycondensation reaction in the presence of a polycondensation catalyst and the like.

Solid-phase polymerization for raising the degree of polymerization or reducing the terminal carboxyl group content of the polymer can preferably be carried out by a conventionally known method.

A small amount of an additive, for example, a lubricant, a pigment, a dye, an antioxidant, a solid-phase polymerization promoter, a fluorescent brightener, an antistatic agent, an antimicrobial agent, an ultraviolet absorber, a light stabilizer, a heat stabilizer, a light screen or a delustering agent, if necessary, may be contained in the copolyester used in the present invention.

The intrinsic viscosity of the polyester fibers of the present invention is preferably within the range of 0.5 to 1.5. When the intrinsic viscosity is within the range, mechanical strength of the finally obtained fibers is sufficiently high and the handling is improved. The intrinsic viscosity is more preferably within the range of 0.52 to 1.4, especially preferably within the range of 0.55 to 1.3.

The terminal carboxyl group concentration of the polyester fibers of the present invention is preferably within the range of 15 eq/ton or below. When the terminal carboxyl group concentration is within the range, the resistance of the fibers to hydrolysis is more improved. The terminal carboxyl group concentration is more preferably within the range of 12 eq/ton or below, especially preferably within the range of 10 eq/ton or below.

The tensile strength of the polyester fibers of the present invention is preferably within the range of 1.5 to 4.5 cN/dtex. When the tensile strength is within the range, performances of the finally obtained products are sufficient and handling is improved. The tensile strength is more preferably within the range of 2.0 to 4.0 cN/dtex, especially preferably within the range of 2.5 to 3.5 cN/dtex.

When the polyester fibers of the present invention are produced, steps of melting spinning and drawing are not especially restricted, and the polyester fibers can be produced with a conventionally known process for producing usual polyester fibers. For example, methods for spinning the polyester, then winding an undrawn yarn and separately drawing the undrawn yarn, methods for continuously drawing the undrawn yarn without winding the undrawn yarn once, methods for melt spinning the polyester, then cooling and solidifying the undrawn yarn in a coagulation bath and subsequently drawing the undrawn yarn under contact heating conditions such as in a heating medium or with a heated roller or the like or with a non-contact type heater or the like.

When the total draw ratio is set so as to be within the range of 2.5 to 6.0 times in drawing the melt spun undrawn yarn, the resistance to hydrolysis and tensile strength of the finally obtained fibers can be made compatible at high levels, the yarn breakage ratio in a drawing step is low and the productivity is more improved. The total draw ratio is more preferably within the range of 2.8 to 5.5 times, especially preferably within the range of 3.0 to 5.0 times.

The drawing step may be passed through only one-stage drawing or two or more drawing stages. When, for example, two-stage drawing is adopted, the draw ratio in the first stage may be 2.0 to 5.5 times, the draw ratio in the second stage may be about 1.0 to 2.0 times and the total draw ratio may be adjusted to 2.5 to 6.0 times.

The shape of a spinneret used in spinning is not restricted when the polyester fibers of the present invention are produced, and any of a circular, a modified-cross section, a solid, a hollow forms and the like can be adopted.

EXAMPLES

The present invention will be more specifically detailed by Examples hereinafter, but the Examples are not intended to limit the present invention at all. Respective values in the Examples were measured according the following methods:

(1) Intrinsic Viscosity:

Measurements were made by using o-chlorophenol as a solvent at 35° C., and the intrinsic viscosity was determined from the relative viscosity thereof according to the conventional method.

(2) Tensile Strength and Tensile Elongation:

Measurement was carried out according to the method described in JIS L1070.

(3) Terminal Carboxyl Group Concentration:

Measurements were made according to the method described in Makromol. Chem., 26, 226 (1958).

(4) Contents of Terephthalic Acid and 2,6-naphthalenedicarboxylic Acid in Polymer:

A sample, together with an excessive amount of methanol, was sealed in a tube and subjected to decomposition with the methanol at 260° C. for 4 hours in an autoclave, and the content of dimethyl terephthalate and the content of dimethyl 2,6-naphthalenedicarboxylate of the resulting decomposition product were determined by using a gas chromatograph (HP6890 Series GC System, manufactured by HEWLETT PACKARD CO.) to determine the molar ratio of the terephthalic acid to the 2,6-naphthalenedicarboxylic acid.

(5) Content of Trimethylene Glycol in Polymer:

A sample, together with an excessive amount of methanol, was sealed in a tube and subjected to decomposition with the methanol at 260° C. for 4 hours in an autoclave, and the content of trimethylene glycol and the content of dimethyl terephthalate of the decomposition product were determined by using the gas chromatograph (HP6890 Series GC System, manufactured by HEWLETT PACKARD CO.) to determine the molar ratio of the trimethylene glycol based on the dimethyl terephthalate.

(6) Evaluation of Resistance to Hydrolysis:

An undrawn yarn was wet-heat treated under conditions of 130° C., 30 hours and 100% RH in an autoclave, and the lowering of intrinsic viscosity before and after the wet-heat treatment was measured to indicate the retention thereof in percentage. The retention of resistance to hydrolysis which is the target of the present invention is 90% or above.

(7) Evaluation of Resistance to Fatigue From Flexing:

The knot strength was measured according to the method described in JIS L1070, and the percentage of the knot strength to the tensile strength was calculated to make relative evaluation.

(8) Glass Transition Temperature:

A sample heated up to 260° C. at a heat-up rate of 10° C./min by using DSC2010 Differential Scanning Calorimeter manufactured by TA Instruments Inc. as a differential scanning calorimeter (DSC) was quenched in a test tube cooled to 0° C. and converted into an amorphous state. The resulting sample was then heated up at a heat-up rate of 10° C./min to measure the midpoint glass transition point according to JIS K7121.

Example 1

A reactor equipped with a stirrer, a rectifying column and a methanol distilling off condenser was charged with 90 parts of dimethyl terephthalate, 12.6 parts of dimethyl 2,6-naphthalenedicarboxylate, 54.9 parts of trimethylene glycol and 0.078 part of titanium tetrabutoxide as a catalyst, and transesterification was carried out while gradually heating up the mixture from 140° C. and distilling off methanol produced as a result of the reaction to the outside of the system. The internal temperature reached 210° C. in 3 hours after starting the reaction.

The resulting reaction product was then transferred to another reactor provided with a stirrer and a glycol distilling off condenser, and polymerization reaction was carried out while gradually heating up the reaction product from 210° C. to 265° C. and reducing the pressure from atmospheric pressure to a high vacuum of 70 Pa. The melt viscosity of the reaction system was traced, and the polymerization reaction was finished when the intrinsic viscosity reached 0.75.

The molten polymer was extruded from the bottom of the reactor into a strand state in cooling water, cut with a strand cutter and formed into chips.

The resulting chips were dried at 160° C. for 2 hours and then subjected to solid-phase polymerization reaction at 200° C. under a vacuum of 70 Pa and the flow of nitrogen gas by using tumbler type solid-phase polymerization equipment. Table 1 shows the results of the intrinsic viscosity and terminal carboxyl group concentration of the obtained polymer.

The resulting polymer was melted and spun at a throughput of 14.3 g/min and a takeoff speed of 400 m/min using an extrusion-spinning machine equipped with a spinneret provided with 24 circular spinning holes having a hole diameter of 0.27 mm. The obtained undrawn yarn was fed to a drawing treating machine equipped with a heating roller at 60° C. and a plate heater at 160° C. and subjected to drawing treatment at a draw ratio of 3.8 times to afford a 94 dtex/24-filament drawn yarn. Table 1 shows the results.

Example 2

Procedures were carried out in the same manner as in Example 1, except that the dicarboxylic acid component was changed into 70 parts of dimethyl terephthalate and 37.7 parts of dimethyl 2,6-naphthalenedicarboxylate in Example 1. Table 1 shows the results.

Example 3

Procedures were carried out in the same manner as in Example 1, except that the dicarboxylic acid component was changed into 50 parts of dimethyl terephthalate and 62.9 parts of dimethyl 2,6-naphthalenedicarboxylate in Example 1. Table 1 shows the results.

Example 4

Procedures were carried out in the same manner as in Example 1, except that the dicarboxylic acid component was changed into 20 parts of dimethyl terephthalate and 100.6 parts of dimethyl 2,6-naphthalenedicarboxylate in Example 1. Table 1 shows the results.

Example 5

Procedures were carried out in the same manner as in Example 1, except that the dicarboxylic acid component was changed into 125.7 parts of dimethyl 2,6-naphthalenedicarboxylate in Example 1. Table 1 shows the results.

Comparative Example 1

A polyethylene terephthalate having an intrinsic viscosity of 0.97 was melted at 285° C. and spun at a throughput of 12.8 g/min and a takeoff speed of 400 m/min by using an extrusion spinning machine equipped with a spinneret provided with 24 circular spinning-holes having a hole diameter of 0.27 mm. The resulting undrawn yarn was fed to a drawing treating machine equipped with a heating roller at 85° C. and a plate heater at 160° C. and subjected to drawing treatment at a draw ratio of 4.3 times to afford a 93 dtex/24-filament drawn yarn. Table 1 shows the results.

Comparative Example 2

Procedures were carried out in the same manner as in Example 1, except that the dicarboxylic acid component was changed into only 100 parts of dimethyl terephthalate to provide a polytrimethylene terephthalate homopolymer in Example 1. Table 1 shows the results.

Example 6

A reactor equipped with a stirrer, a rectifying column and a methanol distilling off condenser was charged with 100 parts of dimethyl terephthalate, 49.4 parts of trimethylene glycol, 10.4 parts of 1,4-cyclohexanedimethanol and 0.078 part of titanium tetrabutoxide as a catalyst, and transesterification was carried out while gradually heating up the mixture from 140° C. and distilling off methanol produced as a result of the reaction to the outside of the system. The internal temperature reached 210° C. in 3 hours after starting the reaction.

The resulting reaction product was then transferred to another reactor provided with a stirrer and a glycol distilling off condenser, and polymerization reaction was carried out while gradually heating up the reaction product from 210° C. to 265° C. and reducing the pressure from the atmospheric pressure to a high vacuum of 70 Pa. The melt viscosity of the reaction system was traced, and the polymerization reaction was finished when the intrinsic viscosity reached 0.75.

The molten polymer was extruded from the bottom of the reactor into a strand state in cooling water, cut with a strand cutter and formed into chips.

The resulting chips were dried at 160° C. for 2 hours and then subjected to solid-phase polymerization reaction at 200° C. under a vacuum of 70 Pa and the flow of nitrogen gas. Table 1 shows the results of the intrinsic viscosity and terminal carboxyl group concentration of the obtained polymer.

The resulting polymer was melted at 265° C. and spun at a throughput of 14.5 g/min and a takeoff speed of 400 m/min by using an extrusion spinning machine equipped with a spinneret provided with 24 circular spinning holes having a hole diameter of 0.27 mm. The obtained undrawn yarn was fed to a drawing treating machine equipped with a heating roller at 60° C. and a plate heater at 160° C. and subjected to drawing treatment at a draw ratio of 3.8 times to afford a 95 dtex/24-filament drawn yarn. Table 1 shows the results.

Example 7

Procedures were carried out in the same manner as in Example 6, except that the glycol component was changed into 43.9 parts of trimethylene glycol and 20.8 parts of 1,4-cyclohexanedimethanol in Example 6. Table 1 shows the results.

Example 8

Procedures were carried out in the same manner as in Example 6, except that the glycol component was changed into 16.5 parts of trimethylene glycol and 72.7 parts of 1,4-cyclohexanedimethanol in Example 6. Table 1 shows the results.

TABLE 1

| | (1) | | | | | | (2) | | | | | (3) | |
|---|---|---|---|---|---|---|---|---|---|---|---|---|---|
| | (4) | (5) | (6) | (7) | (8) | (9) | (5) | (6) | (10) | (11) | (12) | (13) | (14) |
| Ex. 1 | PTT | 1.01 | 11 | 90/10 | 100/0 | 47 | 0.93 | 16 | 94 | 4.5 | 30 | 92 | 83 |
| Ex. 2 | PTT | 0.95 | 13 | 70/30 | 100/0 | 53 | 0.88 | 17 | 95 | 4.7 | 32 | 95 | 80 |
| Ex. 3 | (15) | 0.94 | 12 | 50/50 | 100/0 | 63 | 0.86 | 18 | 93 | 4.6 | 33 | 96 | 78 |
| Ex. 4 | PTN | 0.91 | 14 | 20/80 | 100/0 | 74 | 0.82 | 19 | 93 | 4.8 | 25 | 99 | 76 |
| Ex. 5 | PTN | 0.90 | 14 | 0/100 | 100/0 | 83 | 0.84 | 20 | 92 | 5.2 | 20 | 100 | 75 |
| Ex. 6 | PTT | 1.02 | 9 | 100/0 | 92/8 | 49 | 0.94 | 16 | 95 | 4.5 | 35 | 95 | 88 |
| Ex. 7 | PTT | 1.01 | 10 | 100/0 | 75/25 | 56 | 0.93 | 15 | 95 | 4.4 | 36 | 97 | 85 |

TABLE 1-continued

| | (1) | | | | | | (2) | | | | | (3) | |
|---|---|---|---|---|---|---|---|---|---|---|---|---|---|
| | (4) | (5) | (6) | (7) | (8) | (9) | (5) | (6) | (10) | (11) | (12) | (13) | (14) |
| Ex. 8 | PCT | 0.97 | 12 | 100/0 | 22/78 | 84 | 0.90 | 17 | 93 | 4.7 | 30 | 99 | 80 |
| (16) | PET | 0.97 | 8 | 100/0 | −(18) | 76 | 0.87 | 15 | 93 | 6.1 | 20 | 62 | 70 |
| (17) | PTT | 1.00 | 10 | 100/0 | 100/0 | 44 | 0.93 | 17 | 95 | 4.5 | 37 | 85 | 90 |

Notes:
DMT: Dimethyl terephthalate
DMN: Dimethyl 2,6-naphthalenedicarboxylate
TMG: Trimethylene glycol
CHDM: 1,4-Cyclohexanedimethanol
EG: Ethylene glycol
PTT: Polytrimethylene terephthalate
PTN: Polytrimethylene 2,6-naphthalate
PET: Polyethylene terephthalate
PCT: Poly(1,4-cyclohexanedimethylene)terephthalate
Ex. means "Example".
(1) means "Physical Property of Copolyester".
(2) means "Physical Property of Drawn Yarn".
(3) means "Physical Property of Drawn Yarn after Wet-heat treatment".
(4) means "Main Polymer".
(5) means "Intrinsic Viscosity".
(6) means "Terminal Carboxyl Group Concentration (eq/ton)".
(7) means "DMT/DMN (molar ratio)".
(8) means "TMG/CHDM (molar ratio)".
(9) means "Glass Transition Point (° C.)".
(10) means "Fineness (dtex)".
(11) means "Tensile Strength (cN/dtex)".
(12) means "Tensile Elongation (%)".
(13) means "Resistance to Hydrolysis (%)".
(14) means "Resistance to Fatigue from Flexing (%)".
(15) means "PTT/PTN".
(16) means "Comparative Example 1".
(17) means "Comparative Example 2".
(18) means "(Use of EG)".

Example 9

A reactor equipped with a stirrer, a rectifying column and a methanol distilling off condenser was charged with 90 parts of dimethyl terephthalate, 12.6 parts of dimethyl 2,6-naphthalenedicarboxylate, 70 parts of trimethylene glycol and 0.053 part of titanium tetrabutoxide as a catalyst, and transesterification was carried out while gradually heating up the mixture from 140° C. and distilling off methanol produced as a result of the reaction to the outside of the system. The internal temperature reached 210° C. in 3 hours after starting the reaction.

The resulting reaction product was then transferred to another reactor provided with a stirrer and a glycol distilling off condenser, and polymerization reaction was carried out while gradually heating up the reaction product from 210° C. to 265° C. and reducing the pressure from atmospheric pressure to a high vacuum of 70 Pa. The melt viscosity of the reaction system was traced, and the polymerization reaction was finished when the intrinsic viscosity reached 0.75.

The molten polymer was extruded from the bottom of the reactor into a strand state in cooling water, cut with a strand cutter and formed into chips.

The resulting chips were dried at 130° C. for 5 hours and then subjected to solid-phase polymerization reaction at 190° C. under a vacuum of 70 Pa and the flow of nitrogen gas by using tumbler type solid-phase polymerization equipment. Table 2 shows the results of the intrinsic viscosity and terminal carboxyl group concentration of the obtained chips. A 5 wt. % dichloromethane solution of 2,2'-bisoxazoline was added from a side feeder at a rate so as to provide the amount mentioned in Table 3, mixed with the resulting chips, then melted at 255° C. and spun at a throughput of 14.5 g/min and a takeoff speed of 400 m/min by using an extrusion spinning machine equipped with a spinneret provided with 24 circular spinning holes having a hole diameter of 0.27 mm. The obtained undrawn yarn was fed to a drawing treating machine equipped with a heating roller at 60° C. and a plate heater at 160° C. and subjected to drawing treatment at a draw ratio of 75% of the maximum draw ratio to afford a drawn yarn. Table 3 shows the results.

Example 10

Procedures were carried out in the same manner as in Example 9, except that 126 parts of dimethyl 2,6-naphthalenedicarboxylate was used as the dicarboxylic acid component, the intrinsic viscosity before the solid-phase polymerization was 0.65 and a heating roller at 85° C. was used in Example 9. Tables 2 and 3 show the results.

Example 11

Procedures were carried out in the same manner as in Example 9, except that the glycol component was changed into 62 parts of trimethylene glycol and 20 parts of 1,4-cyclohexanedimethanol in Example 9. Tables 2 and 3 show the results.

Example 12

Procedures were carried out in the same manner as in Example 9, except that the glycol component was changed into 25 parts of trimethylene glycol and 55 parts of 1,4-cyclohexanedimethanol in Example 9. Tables 2 and 3 show the results.

Example 13

Procedures were carried out in the same manner as in Example 9, except that chips dried at 130° C. for 5 hours without carrying out the solid-phase polymerization were used and melt spun in Example 9. Tables 2 and 3 show the results.

Comparative Example 3

Procedures were carried out in the same manner as in Example 9, except that the dicarboxylic acid component was 100 parts of dimethyl terephthalate in Example 9. Tables 2 and 3 show the results.

Example 14

A reactor equipped with a stirrer, a rectifying column and a methanol distilling off condenser was charged with 90 parts of dimethyl terephthalate, 12.6 parts of dimethyl 2,6-naphthalenedicarboxylate, 70 parts of trimethylene glycol and 0.053 part of titanium tetrabutoxide as a catalyst, and transesterification was carried out while gradually heating up the mixture from 140° C. and distilling off methanol produced as a result of the reaction to the outside of the system. The internal temperature reached 210° C. in 3 hours after starting the reaction.

The resulting reaction product was then transferred to another reactor provided with a stirrer and a glycol distilling off condenser, and polymerization reaction was carried out while gradually heating up the reaction product from 210° C. to 265° C. and reducing the pressure from atmospheric pressure to a high vacuum of 70 Pa. The melt viscosity of the reaction system was traced, and the polymerization reaction was finished when the intrinsic viscosity reached 0.75.

The molten polymer was extruded from the bottom of the reactor into a strand state in cooling water, cut with a strand cutter and formed into chips.

The resulting chips were dried at 130° C. for 5 hours and then subjected to solid-phase polymerization reaction at 190° C. under a vacuum of 70 Pa and the flow of nitrogen gas by using tumbler type solid-phase polymerization equipment. Table 2 shows the results of the intrinsic viscosity and terminal carboxyl group concentration of the obtained chips.

The resulting chips were subjected to chip blending with polycarbodiimide master chips [polyethylene terephthalate chips containing 15% by weight of poly(2,4,6-triisopropylphenyl)-1,3-carbodiimide component] in the amount mentioned in Table 3, and the blended chips were then melted at 255° C. and spun at a throughput of 14.5 g/min and a takeoff speed of 400 m/min by using an extrusion spinning machine equipped with a spinneret provided with 24 circular spinning holes having a hole diameter of 0.27 mm. The obtained undrawn yarn was fed to a drawing treating machine equipped with a heating roller at 60° C. and a plate heater at 160° C. and subjected to drawing treatment at a draw ratio of 75% of the maximum draw ratio to afford a drawn yarn. Table 3 shows the results.

Example 15

Procedures were carried out in the same manner as in Example 14, except that the dicarboxylic acid component was changed into 126 parts of dimethyl 2,6-naphthalenedicarboxylate, the intrinsic viscosity before the solid-phase polymerization was 0.65 and a heating roller at 85° C. was used in Example 14. Tables 2 and 3 show the results.

Example 16

Procedures were carried out in the same manner as in Example 14, except that the dicarboxylic acid component was 100 parts of dimethyl terephthalate and the glycol component was changed into 62 parts of trimethylene glycol and 20 parts of 1,4-cyclohexanedimethanol in Example 14. Tables 2 and 3 show the results.

Example 17

Procedures were carried out in the same manner as in Example 14, except that the dicarboxylic acid component was 100 parts of dimethyl terephthalate and the glycol component was changed into 25 parts of trimethylene glycol and 55 parts of 1,4-cyclohexanedimethanol in Example 14. Tables 2 and 3 show the results.

Example 18

Procedures were performed in the same manner as in Example 14, except that the solid-phase polymerization was not carried out in Example 14. Tables 2 and 3 show the results.

Example 19

Procedures were carried out in the same manner as in Example 14, except that molten bis(2,6-diisopropylphenyl) carbodiimide was added from a side feeder at a rate so as to provide the amount mentioned in Table 3 at 75° C. to the blended chips by using an extrusion spinning machine equipped with a spinneret provided with 24 circular spinning holes having a hole diameter of 0.27 mm in Example 14. Tables 2 and 3 show the results.

TABLE 2

| | Physical Property of Copolyester | | | | | | |
|---|---|---|---|---|---|---|---|
| | Composition | | | (1) | | (2) | |
| | (3) | (4) | (5) | (6) | (7) | (6) | (7) |
| Ex. 9 | PTT | 90/10 | 100/0 | 0.75 | 23 | 1.05 | 12 |
| Ex. 10 | PTN | 0/100 | 100/0 | 0.65 | 19 | 0.94 | 10 |
| Ex. 11 | PTT | 100/0 | 80/20 | 0.75 | 21 | 1.03 | 9 |
| Ex. 12 | PTT/PCT | 100/0 | 42/58 | 0.75 | 18 | 1.01 | 8 |
| Ex. 13 | PTT | 90/10 | 100/0 | 0.75 | 23 | — | — |
| Ex. 14 | PTT | 90/10 | 100/0 | 0.75 | 20 | 1.05 | 12 |
| Ex. 15 | PTN | 0/100 | 100/0 | 0.65 | 19 | 0.94 | 10 |
| Ex. 16 | PTT | 100/0 | 80/20 | 0.75 | 12 | 1.03 | 9 |
| Ex. 17 | PTT/PCT | 100/0 | 42/58 | 0.75 | 18 | 1.01 | 8 |
| Ex. 18 | PTT | 100/0 | 100/0 | 0.75 | 23 | — | — |
| Ex. 19 | PTT | 90/10 | 100/0 | 0.75 | 23 | 1.07 | 11 |
| (8) | PTT | 100/0 | 100/0 | 0.75 | 23 | 1.07 | 11 |

Notes:
DMT: Dimethyl terephthalate
DMN: Dimethyl 2,6-naphthalenedicarboxylate
TMG: Trimethylene glycol
CHDM: 1,4-Cyclohexanedimethanol
PTT: Polytrimethylene terephthalate
PTN: Polytrimethylene 2,6-naphthalate
PET: Polyethylene terephthalate
PCT: Poly(1,4-cyclohexanedimethylene)terephthalate
(1) means "Before solid-phase polymerization".
(2) means "After solid-phase polymerization".
(3) means "Main Polymer".
(4) means "DMT/DMN (molar ratio)".
(5) means "TMG/CHDM (molar ratio)".
(6) means "Intrinsic Viscosity".
(7) means "Terminal Carboxyl Group Concentration (eq/ton)".
(8) means "Comparative Example 3".
Ex. means "Example".

TABLE 3

| | (1) | | | | (2) | | | | | (3) | |
|---|---|---|---|---|---|---|---|---|---|---|---|
| | (4) | (5) | (6) | (7) | (8) | (9) | (10) | (11) | (12) | (13) | (14) |
| Ex. 9 | 0.1 | — | — | 3.9 | 1.09 | 5 | 93 | 47 | 31 | 95 | 85 |
| Ex. 10 | 0.2 | — | — | 3.6 | 1.01 | 6 | 100 | 5.4 | 19 | 100 | 78 |
| Ex. 11 | 0.2 | — | — | 3.6 | 1.12 | 5 | 101 | 4.6 | 37 | 99 | 88 |
| Ex. 12 | 0.1 | — | — | 3.7 | 1.04 | 4 | 98 | 4.5 | 39 | 97 | 81 |
| Ex. 13 | 0.5 | — | — | 3.5 | 0.99 | 9 | 104 | 4.4 | 35 | 98 | 87 |
| Ex. 14 | — | 0.3 | — | 3.8 | 0.98 | 6 | 95 | 4.3 | 33 | 97 | 84 |
| Ex. 15 | — | 0.5 | — | 3.5 | 0.89 | 6 | 104 | 5.0 | 22 | 100 | 76 |
| Ex. 16 | — | 0.5 | — | 3.6 | 0.96 | 5 | 104 | 4.4 | 34 | 98 | 85 |
| Ex. 17 | — | 0.3 | — | 3.6 | 0.97 | 6 | 101 | 4.4 | 35 | 96 | 80 |
| Ex. 18 | — | 0.75 | — | 3.6 | 0.90 | 8 | 101 | 4.5 | 35 | 90 | 88 |
| Ex. 19 | — | 0.3 | 0.3 | 3.5 | 1.01 | 8 | 104 | 4.6 | 30 | 96 | 82 |
| (15) | — | — | — | 3.6 | 0.91 | 18 | 100 | 4.3 | 39 | 80 | 92 |

Notes:
(1) means "Yarn Manufacturing".
(2) means "Physical Property of Drawn Yarn".
(3) means "Physical Property of Drawn Yarn after Wet-heat treatment".
(4) means "Amount of Added Bisoxazoline compound (% by Weight)".
(5) means "Amount of Added Polycarbodiimide Compound (% by Weight)".
(6) means "Amount of Added Monocarbodiimide Compound (% by Weight)".
(7) means "Draw Ratio".
(8) means "Intrinsic Viscosity".
(9) means "Terminal Carboxyl Group Concentration (eq/ton)".
(10) means "Fineness (dtex)".
(11) means "Tensile Strength (cN/dtex)".
(12) means "Tensile Elongation (%)".
(13) means "Resistance to Hydrolysis (%)".
(14) means "Resistance to Fatigue from Flexing (%)".
(15) means "Comparative Example 3".
Ex. means "Example".

Industrial Applicability

According to the present invention, there can be provided polyester fibers which have resistances to both hydrolysis and fatigue from flexing at high levels and can usefully be utilized for applications requiring long-term and continuous use at high temperature and humidity such as papermaking canvas, tire cord, sterilized fabrics and the like and the industrial significance of the polyester fibers is great.

What is claimed is:

1. Polyester fibers comprising a copolyester which simultaneously satisfies the following respective requirements (a) to (c), (a) a terephthalic acid component in an amount of 0 to 100 mol % and a 2,6-naphthalenedicarboxylic acid component in an amount of 100 to 0 mol % respectively based on the whole dicarboxylic acid component, wherein the total amount, of the terephthalic acid component and the 2,6-naphthalenedicarboxylic acid component, accounts for 90 mol % or more based on the whole dicarboxylic acid component, (b) a trimethylene glycol component accounts for 22 to 100 mol % and a 1,4-cyclohexanedimethanol component accounts for 78 to 0 mol % respectively based on the whole glycol component, wherein the total amount, of the trimethylene glycol component and the 1,4-cyclohexanedimethanol component, accounts for 90 mol % or more based on the whole glycol component and (c) the sum total value of mol % of the 2,6-naphthalenedicarboxylic acid component and mol % of the 1,4-cyclohexanedimethanol component is 2 mol % or more.

2. The polyester fibers according to claim 1, wherein the glass transition temperature of the copolyester is 45° C. or above.

3. The polyester fibers according to claim 1, wherein the polyester fibers comprise a copolyester having a terminal carboxyl group concentration of 30 eq/ton or below.

4. The polyester fibers according to claim 1, wherein the polyester fibers are obtained by adding a bisoxazoline compound in an amount of 0.05 to 5% by weight based on the copolyester to the copolyester, by uniformly mixing the bisoxazoline compound with the copolyester and then by carrying out melt spinning and have a terminal carboxyl group concentration of 15 eq/ton or below.

5. The polyester fibers according to claim 4, wherein the bisoxazoline compound is 2,2'-bis(2-oxazoline).

6. The polyester fibers according to claim 1, wherein the polyester fibers are obtained by adding a polycarbodiimide compound in an amount of 0.05 to 5% by weight based on the copolyester to the copolyester, by uniformly mixing the polycarbodiimide compound with the copolyester and then by carrying out melt spinning, and have a terminal group concentration of 15 eq/ton or below.

7. The polyester fibers according to claim 6, wherein the polycarbodiimide compound is poly(2,4,6-triisopropylphenyl)-1,3-carbodiimide.

8. The polyester fibers according to claim 6, wherein a monocarbodiimide compound in an amount of 0.01 to 3% by weight based on the copolyester is further added to the copolyester.

9. The polyester fibers according to claim 8, wherein the monocarbodiimide compound is bis(2,6-diisopropylphenyl) carbodiimide.

* * * * *